US007540273B2

(12) United States Patent
Scheffel et al.

(10) Patent No.: US 7,540,273 B2
(45) Date of Patent: Jun. 2, 2009

(54) SUPPORTING ELEMENT

(75) Inventors: Martin Scheffel, Vaihingen (DE); Werner Berger, Markgroeningen (DE); Rainer Norgauer, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/537,668

(22) PCT Filed: Sep. 10, 2003

(86) PCT No.: PCT/DE03/03008

§ 371 (c)(1),
(2), (4) Date: Jul. 3, 2006

(87) PCT Pub. No.: WO2004/051074

PCT Pub. Date: Jun. 17, 2004

(65) Prior Publication Data

US 2006/0266892 A1 Nov. 30, 2006

(30) Foreign Application Priority Data

Dec. 4, 2002 (DE) ..... 102 56 668

(51) Int. Cl.
*F02M 61/14* (2006.01)

(52) U.S. Cl. ..... 123/470

(58) Field of Classification Search ..... 123/467–470
See application file for complete search history.

(56) References Cited

U.S. PATENT DOCUMENTS 4,474,160 A 10/1984 Gartner
5,167,213 A 12/1992 Bassler et al.
5,501,195 A * 3/1996 Hall ..... 123/470
5,520,151 A * 5/1996 Gras et al. ..... 123/470
5,724,946 A * 3/1998 Franchitto ..... 123/470
5,803,052 A * 9/1998 Lorraine et al. ..... 123/470
5,893,351 A * 4/1999 Akutagawa et al. ..... 123/470
5,970,953 A * 10/1999 Lorraine et al. ..... 123/470
6,053,149 A * 4/2000 Lorraine ..... 123/470
6,276,339 B1 * 8/2001 Shebert et al. ..... 123/470
6,637,411 B2 * 10/2003 Makiyama ..... 123/470
6,668,803 B1 * 12/2003 McClean et al. ..... 123/470
6,705,292 B2 * 3/2004 Bugos ..... 123/470
6,748,925 B1 * 6/2004 De Vulpillieres et al. .... 123/470
6,830,037 B1 * 12/2004 Braun et al. ..... 123/470
6,874,477 B1 * 4/2005 Lorraine et al. ..... 123/468
7,063,075 B2 * 6/2006 Berger et al. ..... 123/470
7,210,462 B2 * 5/2007 Scheffel et al. ..... 123/470
7,373,926 B2 * 5/2008 Eckbauer et al. ..... 123/470
2004/0237939 A1 * 12/2004 Kondo et al. ..... 123/470
2008/0105236 A1 * 5/2008 Scheffel et al. ..... 123/470

FOREIGN PATENT DOCUMENTS

DE 29 26 490 4/1992
DE 197 48 593 5/1999

(Continued)

*Primary Examiner*—Hai H Huynh
(74) *Attorney, Agent, or Firm*—Kenyon & Kenyon LLP

(57) ABSTRACT

A support element is provided for the mutual bracing of a fuel injector in a valve seat of a cylinder head of an internal combustion engine and a fuel-distributor line. The support element is formed such that the forces acting on the fuel injector act only in the axial direction and have no radial component.

12 Claims, 3 Drawing Sheets

FOREIGN PATENT DOCUMENTS

| | | |
|---|---|---|
| DE | 100 56 038 | 5/2002 |
| JP | 5893957 | 6/1983 |
| JP | 4500259 | 1/1992 |
| JP | 5500258 | 1/1993 |
| JP | 9291866 | 11/1997 |
| JP | 2000 018127 | 1/2000 |
| WO | WO 90/15240 | 12/1990 |
| WO | WO 00 42315 | 7/2000 |
| WO | WO 01 48370 | 7/2001 |
| WO | WO 02 068813 | 9/2002 |
| WO | WO 02 068815 | 9/2002 |
| WO | WO 03 038267 | 5/2003 |
| WO | WO 03/038267 | 5/2003 |
| WO | WO 03 054383 | 7/2003 |

* cited by examiner

SUPPORTING ELEMENT

FIELD OF THE INVENTION

The present invention relates to a support element for setting a fuel distributor line apart from a fuel injector inserted in a cylinder head of an internal combustion engine.

BACKGROUND INFORMATION

A mounting device for mounting a fuel injector on an intake manifold is described, e.g., from German Patent 29 26 490. In this case, a mounting element axially fixes the fuel injector to the fuel-distributor line or to a plug nipple, the mounting element being designed as a U-shaped securing clamp having two legs which are elastic in the radial direction. In the assembled state, the securing clamp engages in matching recesses of the plug nipple and is snapped into place in a recess in a connection fitting of the fuel injector, the recess being designed as an annular groove. The axial clearance between the recesses and the securing clamp as well as between the annular groove and the securing clamp should be kept small in order to achieve precise fixation of the fuel injector without stresses on the gasket.

Particularly disadvantageous in the mounting device described in German Patent 29 26 490 is the warping effect of the various mounting elements on the fuel injector. The force magnetic flux generates in the fuel injector leads to deformations and thus to lift changes of the valve needle, and even to jamming as well as a compressive and bending load on the housing components, which usually have thin walls and are welded to each other at several points. Furthermore, any mounting measure, for example by means of a contact flange, leads to an increase in the radial expansion of the fuel injector and thus to higher space requirements in the installation.

SUMMARY

The support element for a fuel injector according to the present invention has the advantage over the conventional art that the fuel-distributor line is braced at the fuel injector without radial forces via the support element. As a result, no warping and subsequent damage of the fuel injector and the connection of the fuel-distributor line will occur. The support element not only transmits the holding-down force of the fuel-distributor line to the fuel injector but also provides a flexible fixation that compensates for tolerances and offsets.

It is advantageous that the support element is easy to produce by stamping from sheet metal. It may also be produced by deep-drawing and stamping.

The support element according to the present advantageously dispenses with screws or securing clamping claws for mounting the fuel injector on the front face of the cylinder head.

Punched out recesses, which are easy to produce, advantageously provide secure fixing of the support element at the fuel injector and simple bracing of the fuel-distributor line.

Various guidance variants, such as beveled components whose inclined surfaces slope radially inward, guidance by the cylinder head, or by projections engaging with each other from behind, also brace the radial forces of the support element.

Especially advantageous in this context is the contacting of the edges of the support element along the axial extension of the support element in a radially inward direction, so that the support element abuts against the fuel injector along its entire length, thereby preventing the support element from bending open.

Various tab forms may be configured in such a way that a more or less pronounced elastic and plastic deformation allows optimal bracing between the fuel-distributor line and the fuel injector under the given installation situation.

DETAILED DESCRIPTION

Figure 1A:
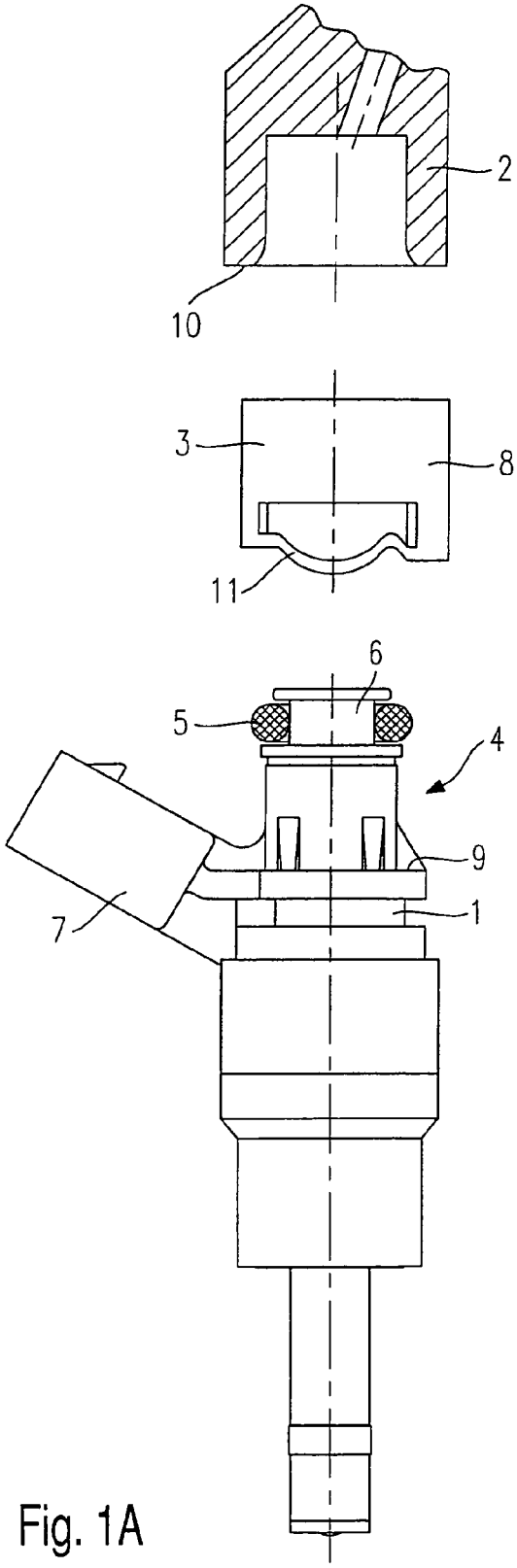
FIG. 1A shows an exploded, schematic, part-sectional view of an exemplary embodiment of a fuel injector able to be combined with a support element configure according to the present invention, prior to mounting.
Figure 1B:
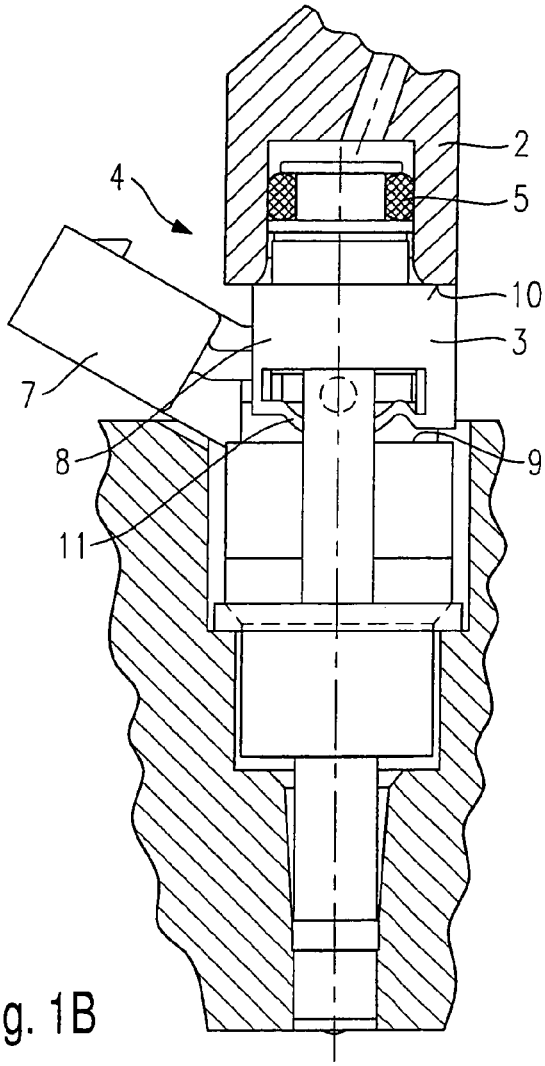
FIG. 1B shows a schematic, part-sectional view of the exemplary embodiment shown in FIG. 1A, in the mounted state.
Figure 1C:
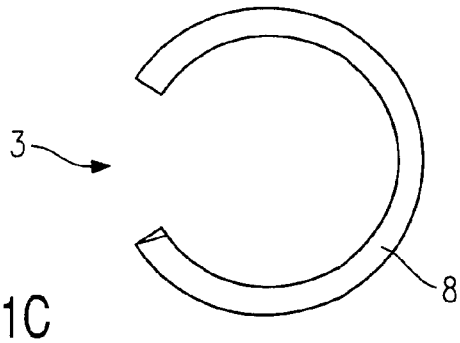
FIG. 1C shows a plan view of the exemplary embodiment of the support element configured according to the present invention, shown in FIGS. 1A and 1B.

FIGS. 1A through 1C show schematized part-sections through an exemplary embodiment of a fuel injector 1, a fuel-distributor line 2, and a support element 3 which is configured according to the present invention and to be mounted in-between, shown in a view before (FIG. 1A) and after (FIG. 1B) mounting of said components.

In this context, a fuel injector 1 is designed in the form of a direct-injection fuel injector 1, which may be installed in a valve seat of a cylinder head for the direct injection of fuel into a combustion chamber of a mixture-compressing internal combustion engine having externally supplied ignition (not shown further). The valve seat may also be provided at a connecting piece of an intake manifold (not shown). At an inflow-side end, fuel injector 1 is provided with a plug connection to a connecting piece of fuel-distributor line 2, which is sealed by a gasket 5 between fuel distributor line 2 and a supply nipple 6 of fuel injector 1. Fuel injector 1 has an electrical connection 7 for the electrical contacting to actuate fuel injector 1.

Support element 3 according to the present invention is provided to space fuel injector 1 and fuel-distributor line 2 apart from one another in a manner that is free of radial forces. Support element 3 is made up of a clamp 8, which is braced against a shoulder 9 of fuel injector 1 on one side and against a shoulder 10 of fuel-distributor line 2 on the other side. For easier mounting, clamp 8 has a slot in the region of electrical connection 7 of fuel injector 1.

Figure 3C:
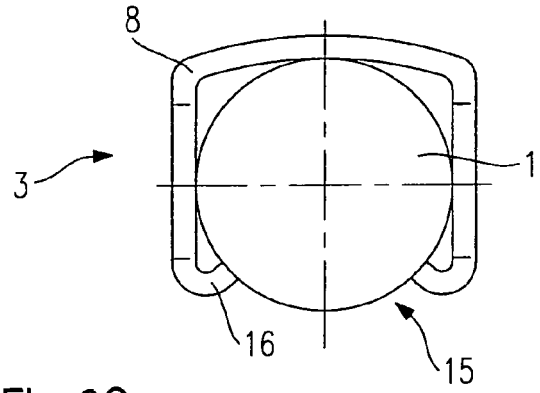
Figure 4:
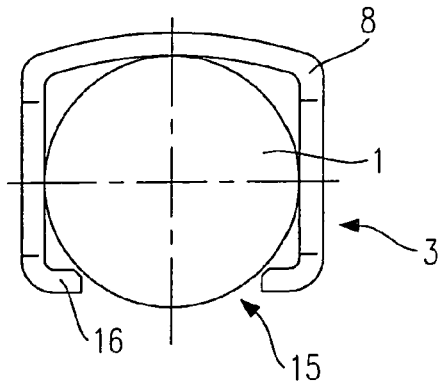
FIG. 4 shows a sixth exemplary embodiment of a support element free of radial forces.

It may be gathered from FIG. 1C that the first exemplary embodiment of a support element 3 configured according to the present invention has a round cross-section. Alternative forms are shown in FIGS. 3C and 4.

Two tabs 11 are connected to clamp 8 and provide flexible bracing of fuel-distributor line 2 with respect to fuel injector 1. A detailed representation of clamp 8 may be gathered from the views in FIGS. 3A through 3C, 4 and 5A through 5C, as well as from the following description.

FIGS. 2A through 2D show schematic, part-sectional views of portions of the fuel-injection system shown in FIGS. 1A and 1B, in the region of connection nipple 6 of fuel injector 1 and fuel-distributor line 2.

FIGS. 2A through 2D represent various example embodiments of bracing the radial forces between support element 3 and fuel injector 1 in the case of support elements 3 having a round design.

Figure 2A:
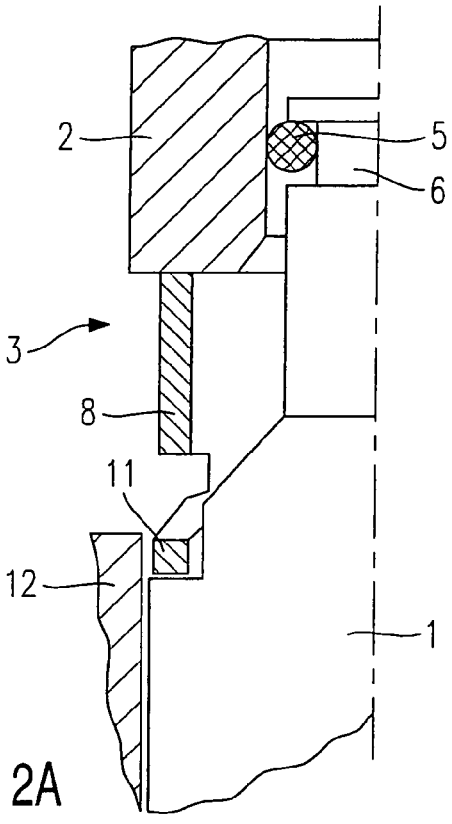
FIGS. 2A-2D show four example embodiments of support elements configured to be free of radial forces.

FIG. 2A shows a first, least complicated embodiment in which support element 3 is guided by a guide element 12, which may be the cylinder head, for example, in such a way that a radial displacement of support element 3 in response to the pressure exerted by fuel-distributor line 2 is impossible.

Figure 2B:
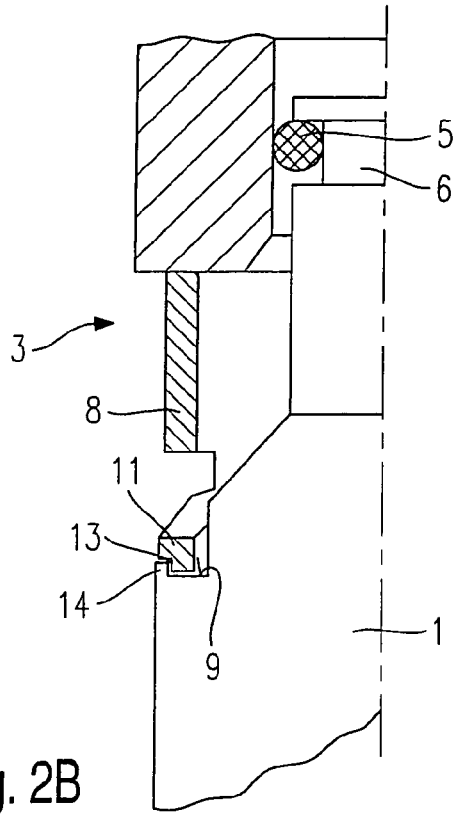

A similar possibility is offered by a keyed connection, as shown in FIG. 2B. In this case, support element 3 is provided with an at least partially circumferential groove 13, which, together with a projection 14 formed at shoulder 9 of fuel injector 1, ensures, by mutual engagement, that tabs 11 of support element 3 do not shift radially.

Figure 2C:
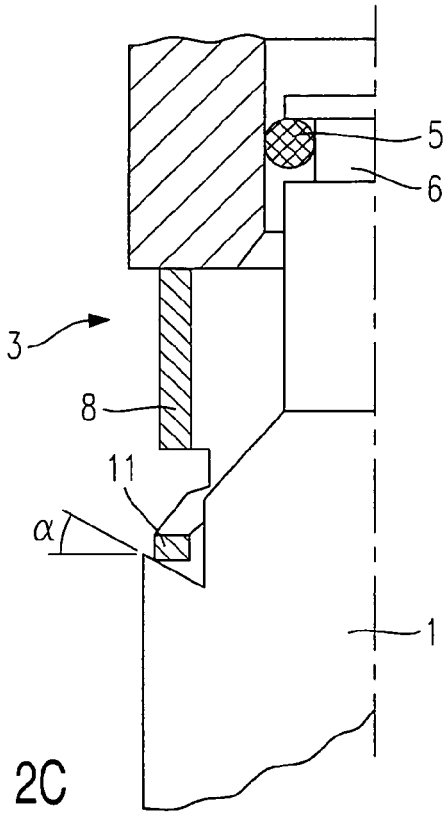
Figure 2D:
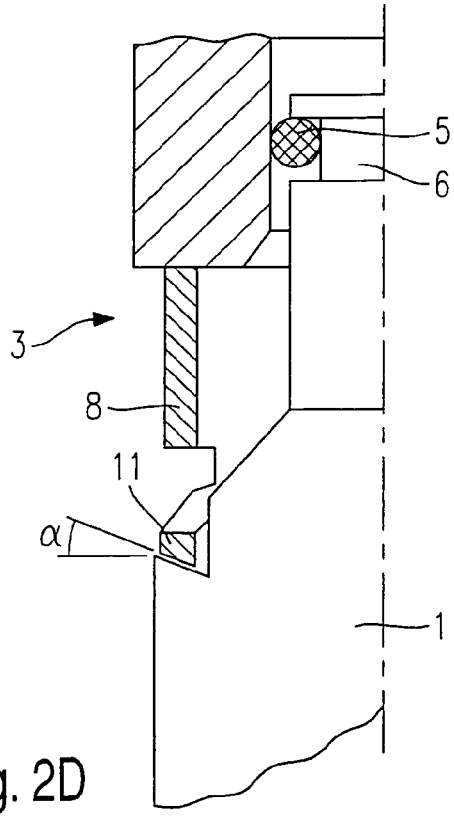

A beveling of shoulder 9 of fuel injector 1 and/or tabs 11 of support element 3 also suggests itself for the bracing of fuel injector 1 at shoulder 9 in manner that is free of radial forces. In FIG. 2C, only shoulder 9 is inclined at an angle $\alpha$, while in FIG. 2D both shoulder 9 of fuel injector 1 and tabs 11 of support element 3 are inclined, preferably at the same $\alpha$ angle. This measure, too, can prevent shifting of tabs 11 under axial force. The variant of an embodiment illustrated in FIG. 2C has the advantage of uncomplicated manufacturability, support element 3 being able to be adopted unchanged.

FIGS. 3A through 3C and 4 represent schematic views and partial sections of exemplary embodiments of a support element 3 configured according to the present invention, in the unmounted state. Equivalent components have been provided with corresponding reference numerals in all figures.

Figure 3A:
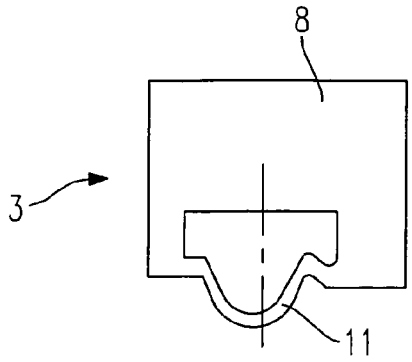
FIGS. 3A-3C show three different views of a fifth example embodiment of a support element free of radial forces.
Figure 3B:
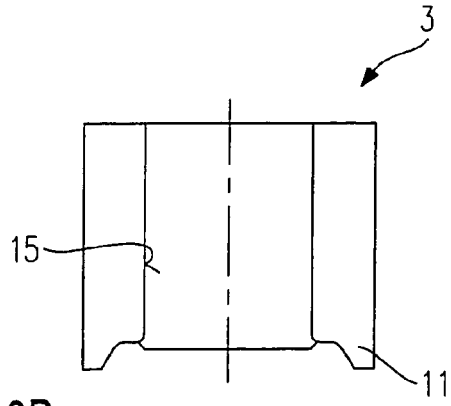

FIG. 3A shows a side view of an example embodiment of a support element 3 configured according to the present invention; FIG. 3B a frontal view; FIG. 3C a plan view from above. FIG. 4 shows a plan view from above of an example embodiment that is to be considered an alternative to FIG. 3C.

FIG. 3A shows support element 3 configured according to the present invention with clamp 8 and tabs 11. Tabs 11, due to their form and their extension at clamp 8, are configured in such a way that they may be deformed plastically/elastically, thereby introducing an axial force into fuel injector 1. As can be gathered from FIG. 1B, clamps 11 rest against shoulder 9 of fuel injector 1.

FIG. 3B shows a view of the slotted side of support element 3. In the installed state of support element 3, electrical connection 7 of fuel injector 1 lies in the region of slot 15.

FIGS. 3C and 4, in the same view, show two example embodiments of support element 3, viewed in the discharge direction. Support element 3 is not round on one side but has a roughly rectangular or square cross-section form in order to prevent radial shifting of support element 3 in response to the axial introduction of force by fuel-distributor line 2. Such force may lead to warping of fuel injector 1 in the cylinder head or deformations of fuel injector 1 and subsequent malfunctions, for example by jamming of the valve needle of fuel injector 1. In addition, edges 16, which form the end of clamp 8 on both sides of slot 15, are folded radially inward in the direction of fuel injector 1. This ensures that edges 16 contact fuel injector 1 along their full axial length, so that shifting of support element 3 is prevented.

The embodiment shown in FIG. 4 has the advantage of simple manufacturability and a high clamping effect, whereas the exemplary embodiment illustrated in FIG. 3C effectively prevents the edges from bending open.

Figure 5A:
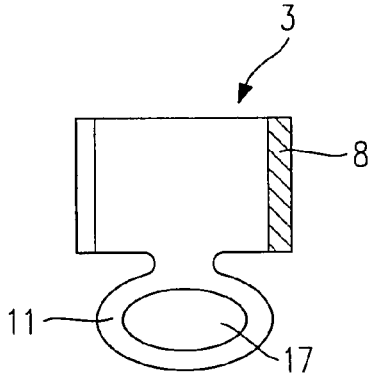
FIGS. 5A-5C show three different views of a seventh example embodiment of a support element free of radial forces.
Figure 5B:
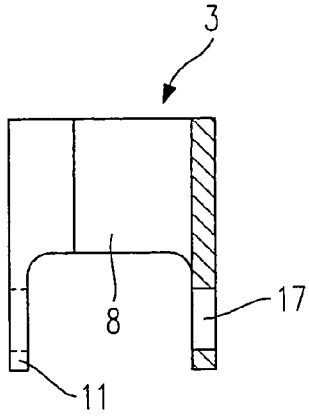
Figure 5C:
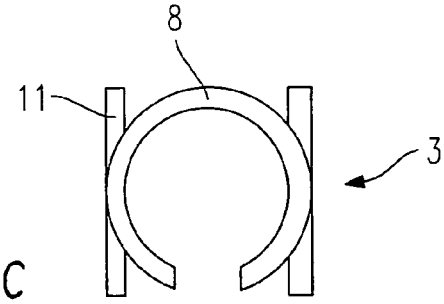

FIGS. 5A through 5C show an additional exemplary embodiment of a support element 3 configured according to the present invention. It has annular tabs 11, which are connected to clamp 8. A recess 17 in annular tabs 11 provides higher elasticity of tabs 11 and thus greater tolerance with respect to axial twisting. Edges 16 may be configured as shown in FIGS. 3C or 4.

Due to the flexible mutual bracing of the components, it is not only possible to compensate for axial forces generated by fuel-distributor line 2, but also for manufacturing tolerances and linear deformations due to heating during operation of the internal combustion engine.

The present invention is not limited to the exemplary embodiments shown and is also applicable to fuel injectors for injection into the combustion chamber of an internal combustion engine having self-ignition.

What is claimed is:

1. A support element for mutually bracing a fuel injector and a fuel-distributor line, comprising:

at least a first portion for bracing against the fuel injector; and at least a second portion for bracing against the fuel-distributor line;

wherein the support element is adapted to space the fuel injector and the fuel-distributor line apart from one another in a manner that is free of radial forces;

wherein the support element includes a clamp which is braced against a shoulder of the fuel injector on one side and against a shoulder of the fuel-distributor line on another side; and wherein the support element includes tabs that are integrally formed with the support element and are elastically deformable in an axial direction of the fuel injector and the fuel distributor line.

2. The support element as recited in claim 1, wherein the tabs are supported at a shoulder of the fuel injector.

3. The support element as recited in claim 1, wherein the clamp has a slot in a region of an electrical connection element of the fuel injector.

4. The support element as recited in claim 1, wherein the clamp is made from spring steel by stamping.

5. The support element as recited in claim 1, wherein the clamp has edges that are radially folded over to the inside and abut against the fuel injector.

6. The support element as recited in claim 1, wherein the support element has one of a rectangular and square cross-section.

7. The support element as recited in claim 1, wherein the support element braces the fuel injector with respect to the fuel-distributor line.

8. The support element as recited in claim 1, wherein the fuel injector is installed in a valve seat of a cylinder head of an internal combustion engine, and wherein the support element is guided by the cylinder head.

9. The support element as recited in claim 1, wherein the tabs of the support element have a circumferential groove.

10. The support element as recited in claim 9, wherein the circumferential groove engages with a projection formed at a shoulder of the fuel injector.

11. The support element as recited in claim 10, wherein the shoulder formed on the fuel injector is radially inclined inwardly at a selected angle.

12. The support element as recited in claim 11, wherein contact surfaces of the tabs of the support element are inclined at an angle substantially similar to the selected angle.

* * * * *